US009340918B2

(12) United States Patent
Lv et al.

(10) Patent No.: US 9,340,918 B2
(45) Date of Patent: May 17, 2016

(54) WASHING MACHINE FOR AUTO-ADDED WASHING AGENT BY NEGATIVE PRESSURE AND CONTROLLING METHOD THEREOF

(75) Inventors: Peishi Lv, Qingdao (CN); Sheng Xu, Qingdao (CN); Lin Yang, Qingdao (CN); Wenwei Li, Qingdao (CN); Xuguang Yang, Qingdao (CN); Qiuying Gao, Qingdao (CN)

(73) Assignees: HAIER GROUP CORPORATION, Qingdao, Shandong (CN); QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 1010 days.

(21) Appl. No.: 13/512,526

(22) PCT Filed: Dec. 3, 2010

(86) PCT No.: PCT/CN2010/079417

§ 371 (c)(1),
(2), (4) Date: May 29, 2012

(87) PCT Pub. No.: WO2011/066805

PCT Pub. Date: Jun. 9, 2011

(65) Prior Publication Data

US 2012/0240344 A1 Sep. 27, 2012

(30) Foreign Application Priority Data

Dec. 3, 2009 (CN) ..... 2009 1 0250314
Dec. 29, 2009 (CN) ..... 2009 1 0265894

(51) Int. Cl.
*D06F 39/02* (2006.01)
*D06F 39/08* (2006.01)
*A47L 15/44* (2006.01)

(52) U.S. Cl.
CPC ..... *D06F 39/022* (2013.01); *A47L 15/449* (2013.01); *A47L 15/4463* (2013.01);

(Continued)

(58) Field of Classification Search
CPC ..... D06F 39/02; D06F 39/022
See application file for complete search history.

(56) References Cited

U.S. PATENT DOCUMENTS 3,881,328 A 5/1975 Kleimola et al.
5,680,663 A * 10/1997 Mitchell ..... D06F 39/022 127/28

(Continued)

FOREIGN PATENT DOCUMENTS

CN 2292106 Y 9/1998
CN 1228490 A 9/1999

(Continued)

OTHER PUBLICATIONS

International Search Report (PCT/ISA/210) issued on Mar. 10, 2011, by the Chinese Patent Office as the International Searching Authority for International Application No. PCT/CN2010/079417.

(Continued)

*Primary Examiner* — Jason Ko
*Assistant Examiner* — Spencer Bell
(74) *Attorney, Agent, or Firm* — Buchanan Ingersoll & Rooney PC

(57) ABSTRACT

A washing machine for automatically adding the detergent by negative pressure comprises a water inlet, a detergent container and a tub. A main inflow waterway and a rinse waterway are provided between the water inlet and the tub. A dosing container which communicates with the detergent container is provided between the rinse waterway and the tub. A venturi tube is provided in the main inflow waterway. Due to venturi effect, the main inflow water stream becomes narrower and the water inflowing velocity is accelerated, so that a relative vacuum area which communicates with the dosing container is formed at the rear side of the venturi tube outlet, negative pressure is generated in the dosing container, and the detergent in the detergent container.

22 Claims, 5 Drawing Sheets

(52) U.S. Cl.
CPC ..... *D06F39/028* (2013.01); *D06F 39/088* (2013.01); *D06F 2202/10* (2013.01); *D06F 2204/02* (2013.01)

(56) References Cited

U.S. PATENT DOCUMENTS

| | | | |
|---|---|---|---|
| 2006/0107705 | A1 | 5/2006 | Hsu et al. |
| 2006/0272360 | A1 | 12/2006 | Hsu et al. |
| 2007/0131000 | A1 | 6/2007 | Jeong |
| 2010/0000264 | A1* | 1/2010 | Luckman et al. ..... 68/4 |

FOREIGN PATENT DOCUMENTS

| | | | |
|---|---|---|---|
| CN | 1616740 | A | 5/2005 |
| CN | 1978743 | A | 6/2007 |
| CN | 201058937 | Y | 5/2008 |
| CN | 101381939 | A | 3/2009 |
| CN | 201258409 | Y | 6/2009 |
| CN | 101956311 | A | 1/2011 |
| DE | 102008028253 | A1 | 1/2009 |
| EP | 0033684 | A1 | 8/1981 |
| EP | 1 728 912 | A1 | 12/2006 |
| FR | 2410697 | A1 | 6/1979 |

OTHER PUBLICATIONS

Search Report issued by the European Patent Office on Feb. 1, 2016 in corresponding European Application No. 10834238.7 (8 pages).

* cited by examiner

WASHING MACHINE FOR AUTO-ADDED WASHING AGENT BY NEGATIVE PRESSURE AND CONTROLLING METHOD THEREOF

FIELD OF THE INVENTION

The invention relates to a washing machine and controlling method thereof, specifically to a method for adding washing agent to the washing machine, and more particularly to a washing machine for auto-added washing agent by negative pressure and controlling method thereof.

BACKGROUND OF THE INVENTION

For conventional washing machines, as washing agents are placed separately from the washing machines in washing course, and feeding device for washing agent is not provided on the washing machine, the washing agent cannot be automatically added, thus the configuration cannot realize the washing course fully automatically controlled by the washing machine. With the improvement of automation of washing machine, detergent box containing washing agent and/or softener communicates with water inlet pipeline in most of washing machine, and the detergent and/or softener in the detergent box are flushed into tub by inflow water, however, in the configuration, the washing agent and/or softener must be placed in the detergent box in advance for every washing course, thus, it also does not realize the washing course fully automatically controlled.

So far, there are a lot of patent applications for auto-feeding device with washing agent. The Chinese patent with the application No. 97208723.0 discloses a feeding device with a washing agent for washing machine, in which a chamber being matched with a bottle is arranged on a washing machine body; the bottom of the chamber is a cone-shaped through hole; a vertical fixed sheet which fixes a liquid detergent conduit pipe is fixed on the cone-shaped through hole; the body of the bottle is matched with the chamber; a cone-shaped ingress pipe is arranged on the opening of the bottle whose bottom is provided with an air exchange opening. The configuration is unable to control adding amount of washing agent, and is susceptible to damage, thus leads to waste of the washing agent.

The Chinese application with the application No 99101767.6 discloses a washing machine capable of automatically supplying liquid washing agent, comprising: a tub, a detergent box, a valve for opening or closing the feeding channel, controlling the amount of the detergent added to the tub through the feed hole on the bottom of the detergent box, and a sensor for detecting the amount of the laundry detergent which is provided in the detergent box. The configuration directly discharges the undiluted washing agent into the tub, thus lead to the situation that the clothes may be damaged.

The Chinese application with the application No 200610136059.9 discloses a feeding detergent device for a washing machine having detergent box with siphon unit. The washing agent is injected into the detergent box, then wash water is also injected into the box, and the diluted detergent is discharged from the siphon unit into the tub after the washing argent is diluted. The invention solves the problem of clothes damage caused by directly discharging the concentrated washing agent into the tub, but the accurate control for automatically adding the washing agent cannot be realized.

The Chinese application with the application No 200710146295.3, which is a prior application of the applicant, discloses an automatic detergent-adding washing machine and a wash method. The washing machine comprises: a washing tub, a control panel comprising all kinds of texture control buttons, a sensor for detecting weight of the clothes to be washed, a temperature sensor located in the washing tub, a water hardness sensor, a dirtiness sensor for washing water, a detergent box and computer board; the detergent box comprises upper storage box and lower diluting box, and the computer board controls the amount of the detergent in the storage box feeding in the diluting box according to the detection results of the sensors. A detergent inlet is set on the upper cover of the storage box, and detergent outlet and solenoid valve for controlling the closing and opening of the outlet are set on the bottom; a water injection tube for connecting the water inlet valve of the washing machine is set at the side of the diluting box and a siphon discharge tube is set at the bottom; on the upper cover of the storage box is provided the excitation coil of the solenoid valve whose armature is connected to the cone-shaped valve plug on the detergent outlet at the bottom of the storage box via valve stem, and compression spring is provided between the cone-shaped valve plug and the upper cover of the storage box. Though the configuration is able to realize accurate control of the detergent, the configuration is of complicated structure and high cost.

The invention is proposed in consideration of the above.

SUMMARY OF THE INVENTION

The technical problems to be solved by the invention is to overcome defects of the prior art, and provide a method for automatically adding the detergent at the most reasonable amount by the suction generated from the negative pressure of the water stream on the premise of assuring washing effects, in accordance with the detection results of other factors such as weight of the clothes, dirtiness, texture, temperature of water, quality of the wash water, etc.

Another objective of the present invention is to provide a washing machine for auto-added washing agent by negative pressure.

A further objective of the present invention is to provide a controlling method for automatically adding detergent into washing machine.

To solve the above technical problems, the basic conceive of the technical scheme of the invention is: a method for automatically adding a detergent by negative pressure, in which water is supplied into a tub through a main inflow waterway, and the detergent is rushed into the tub through the rinse waterway, the detergent in a detergent container is pumped into a dosing container by a negative pressure generated by the water stream of the main inflow waterway during supplying water in the main inflow waterway, then the detergent is diluted and rushed into the tub by inflow water from the rinse waterway into the dosing container, The above process is repeated one or more time(s) to realize automatically adding the quantitative detergent.

The amount of the detergent to be added is calculated according to quantity of clothes in the tub, and/or texture, and/or dirtiness, and/or inflow water temperature, and/or water quality, and then the times of extraction of the detergent into the dosing container by the negative pressure of the water stream is calculated.

A venturi tube is arranged in the main inflow waterway. The water stream becomes narrower and the inflow velocity is accelerated by utilizing venturi effect, so that a relative vacuum area which communicates with the dosing container is formed at the rear side of an outlet of the venturi tube. Thus, the detergent in the detergent container which communicates with the dosing container is pumped into the dosing container by a negative pressure generating in the dosing container.

Before water is supplied from the main inflow waterway, the dosing container is separated from the rinse waterway and the tub, and the dosing container communicates with the main inflow waterway and the detergent container. After the detergent is pumped into the dosing container at set rate by the negative pressure during water is supplied in the main inflow waterway, the dosing container is separated from the main inflow waterway, and water begins to be supplied from the rinse waterway. A passages between the dosing container and the rinse waterway and the tub are opened, and a passage between the dosing container and the detergent container is closed, so that the detergent is diluted and rushed into the tub.

A control valve is commonly used for controlling between the dosing container and the rinse waterway and between the dosing container and the detergent container. When the dosing container is separated from the rinse waterway, the dosing container communicates with the detergent container, otherwise, when the dosing container communicates with the rinse waterway, the dosing container is separated from the detergent container.

After total amount of the detergent meets the pre-set volume for washing by repeatedly pumping the detergent into the dosing container by the negative pressure as well as diluting and rushing the detergent into the tub through the rinse waterway, water from the rinse waterway and the main inflow waterway is simultaneously supplied until the washing water in the tub reaches the pre-set water level, then inflowing water is stopped.

A washing machine for utilizing the method for automatically adding the detergent, comprises a water inlet, a detergent container and a tub. Two water inflowing water passages which are respectively a main inflow waterway and a rinse waterway arc set between the water inlet and the tub. A dosing container which communicates with the detergent container is arranged between the rinse waterway and the tub. A venturi tube by which a negative pressure is generated during passing water stream is arranged in the main inflow waterway. A branch pipe which communicates with the dosing container is arranged at the rear side of the outlet of the venturi tube. The detergent in the detergent container is pumped into the dosing container by the negative pressure generated during feeding water from the main inflow waterway into the tub, and then is diluted and rushed into the tub by the inflowing water from the rinse waterway to the dosing container.

A main inlet valve is arranged between the main inflow waterway and the water inlet, and a rinse water valve is arranged between the rinse waterway and the water inlet. A wash control valve is set between the rinse water valve and the dosing container, and a sealing control valve for sealing the connection is arranged at a connection between the dosing container and the branch pipe, and a water intake control valve is arranged between the dosing container and the tub.

A configuration with one-way valve is set between the rinse water valve and the wash control valve, thus, avoids that the detergent reversely flow into water source through the rinse water valve to pollute water when negative pressure is generated at one end of the rinse water valve.

The detergent container is at least one in quantity, and each detergent container is filled with liquid detergent, liquid softener, liquid disinfectant, or other liquid for washing. Passages are arranged between the rinse water valve and the dosing container and between the detergent container and the dosing container with the same quantity as that of the detergent container. The wash control valve is set on each passage, and the wash control valve simultaneously controls communication among the passages and seal between the corresponding dosing container and the detergent container, and simultaneously controls closure of the passages and communication between the corresponding dosing container and the detergent container.

The dosing container communicates with the detergent containers containing different types of detergents respectively, and a detergent control valve is set at the connection between the detergent container and the dosing container, and the wash control valve between the rinse water valve and the dosing container is set at the connection of the dosing container.

The wash control valve comprises an electromagnet generating drive and magnetic ball valves encapsulated with rubber. After the electromagnet is electrified, it absorbs the magnetic ball valves to close the passage between the rinse water valve and the dosing container and open the passage between the dosing container and the detergent container, or otherwise after the electromagnet is powered off, the inflow water from the rinse waterway impacts the magnetic ball valves, so that the passage between the rinse water valve and the dosing container is opened and the passage between the dosing container and the detergent container is closed. The sealing control valve and the water intake control valve are buoyancy ball valve or solenoid valve.

The wash control valve and the detergent control valve are both solenoid valves, and the sealing control valve and the water intake control valve are buoyancy ball valve or solenoid valve.

The detergent container is a detergent box fixed on the washing machine or a detergent container set on the outside of the washing machine. The detergent container hermetically communicates with the dosing container.

Inflow water from the main inflow waterway and the rinse waterway flows into the tub via the same water inlet box.

Two probes for detecting whether there is detergent are arranged in the detergent container, among which, one is located at a side of a lower portion of the detergent container and inward inserted from the side, the other is located at a side of a lower portion of the container and inserted inward from the side, or located at an upper side of an upper portion of the container and inserted from the upper to the lower. The two probes do not touch each other at their upper or lower portions.

The washing machine of the invention is a swirl washing machine, a drum washing machine, or other type. Other water inlet passages for the own functions of washing machine can also be provided between the water inlet and the tub, such as passage for flushing condensate water, etc.

A control method for the washing machine is: the amount of added detergent being automatically calculated by the washing machine according to quantity of clothes in the tub, texture, dirtiness, inflow water temperature, and/or water quality, as well as the selected wash procedures and the types of the detergent, after the washing machine is powered on, and then the times of extraction of the detergent being derived according to the volume of the dosing container, and the detergent being automatically pumped into the dosing container by the negative pressure generated by the inflow water flowing the venturi tube during supplying water in the main inflow waterway, then the detergent being diluted and rushed into the tub by an inflow water from the rinse waterway into the dosing container, and the action for automatically adding the detergent on a quantitative basis being realized by one or more repeated dosing(s).

Time for taking to fully fill the dosing container with the detergent is mainly determined by the flow of the inflow water in the main inflow waterway and the volume of the dosing container. Time for the inflow water reaching the set water level is calculated according to flow of the inflow water in the main inflow waterway, and the maximum times of automatically adding the detergent are derived for each course of water inflow. If the time for water inflow in the main inflow waterway cannot meet the time for adding the required detergent, the user is reminded to manually add detergent, select common or concentrated detergent according to types of the detergent, or select repeated wash.

When the detergent is required to be added each time, water is at first supplied from the main inflow waterway, and the dosing container is automatically separated from the main inflow waterway after the detergent is pumped into and fully fills the dosing container by negative pressure; after the dosing container is fully filled, the main inflow waterway is closed, and water inflow from the rinse waterway is taken place, the passage between the dosing container and the rinse waterway and the tub are opened, at the same time, the passage between the dosing container and the detergent container is closed, so that the detergent is diluted and rushed into the tub.

After the detergent in the dosing container is diluted and rushed into the tub each time, the main inflow waterway and the rinse waterway are closed, and the dosing container is emptied. Time for emptying is determined according to the volume of the dosing container.

Water is supplied by both the main inflow waterway and the rinse waterway, when water inflow on the condition of without the detergent addition or after the detergent has already been completed.

The specific steps for automatically adding the detergent in the wash course is following:

First step, detecting clothes, and judging the number of times for adding the detergent;

Second step, starting to inflood water from the main inflow waterway;

Third step, pumping the detergent into the dosing container;

Fourth step, closing the main inflow waterway and opening the rinse waterway, diluting and rushing the detergent into the tub;

Fifth step, closing the rinse waterway, and emptying the dosing container;

Sixth step, judging whether it is required to add the detergent once again, if yes, turning to the second step, or otherwise, going to the next step;

Seventh step, judging whether the preset water level is reached, if yes, going to the ninth step, or otherwise, going to the next step;

Eighth step, inflooding water from both the main inflow waterway and the rinse waterway until the preset water level is reached;

Ninth step, closing the main inflow waterway and the rinse waterway, and executing wash;

Tenth step, judging whether repeated wash is required at the end of the wash, if yes, turning to the second step, or otherwise, going to rinse after wash finishes.

The specific steps for automatically adding softener in the rinse course is following:

First step, starting rinse;

Second step, judging whether to add softener, if yes, going to the next step, or otherwise, going to the eighth step;

Third step, starting to inflood water from the main inflow waterway, and pumping the softener into the dosing container;

Fourth step, closing the main inflow waterway and opening the rinse waterway, diluting and rushing the softener into the tub;

Fifth step, closing the rinse waterway and emptying the dosing container;

Sixth step, judging whether it is required to add the softener once again, if yes, turning to the third step, or otherwise, going to the next step;

Seventh step, judging whether the preset water level is reached, if yes, turning to the ninth step, or otherwise, going to the next step;

Eighth step, inflooding water from both the main flow waterway and the rinse waterway until the preset water level is reached;

Ninth step, closing the main flow waterway and the rinse waterway, and executing rinse;

Tenth step, finishing the rinse, and executing rushing for the dosing container before water is drained.

Compared with the prior art, the advantageous effects of the invention is as follows by adopting the technical scheme.

A washing machine for automatically adding the detergent at the most reasonable amount by the negative pressure generated from the water stream under the premise of no impact on wash effects and the specific method thereof for automatically adding the detergent during wash and rinse in the washing machine. Automatically addition of the detergent is realized by suction from the negative pressure generated from the water stream in the water inflow course and simple configuration is adopted, so that the burden of manually adding detergent is eased, and the shortage or excess of the detergent is avoided. At the same time, by replacing other configurations for automatically adding the detergent, the costs of the production and installation are saved, the full automation of wash course is realized, and the wash efficiency is improved.

In combination with the attached drawings, the following contents provide further description of the preferred embodiments of the invention in detail.

DETAILED DESCRIPTION OF THE PREFERRED EMBODIMENTS

Figure 1:
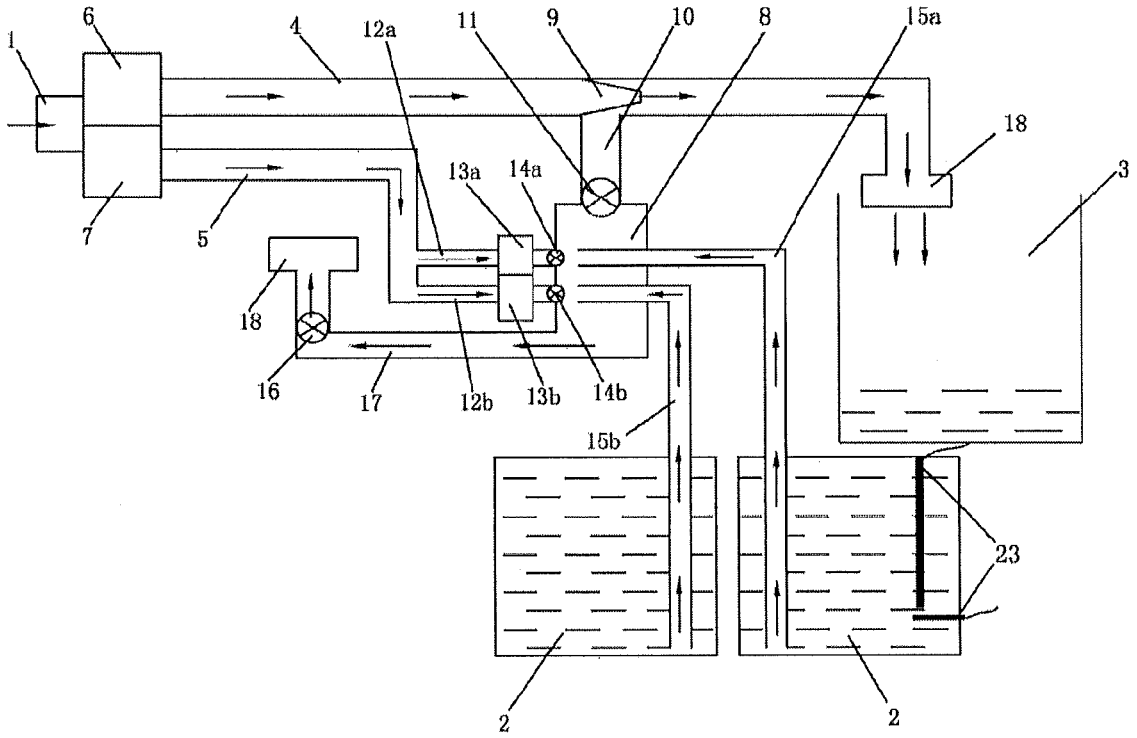
FIG. 1 is a schematic of configuration of the washing machine for automatically adding detergent in the invention.
Figure 2:
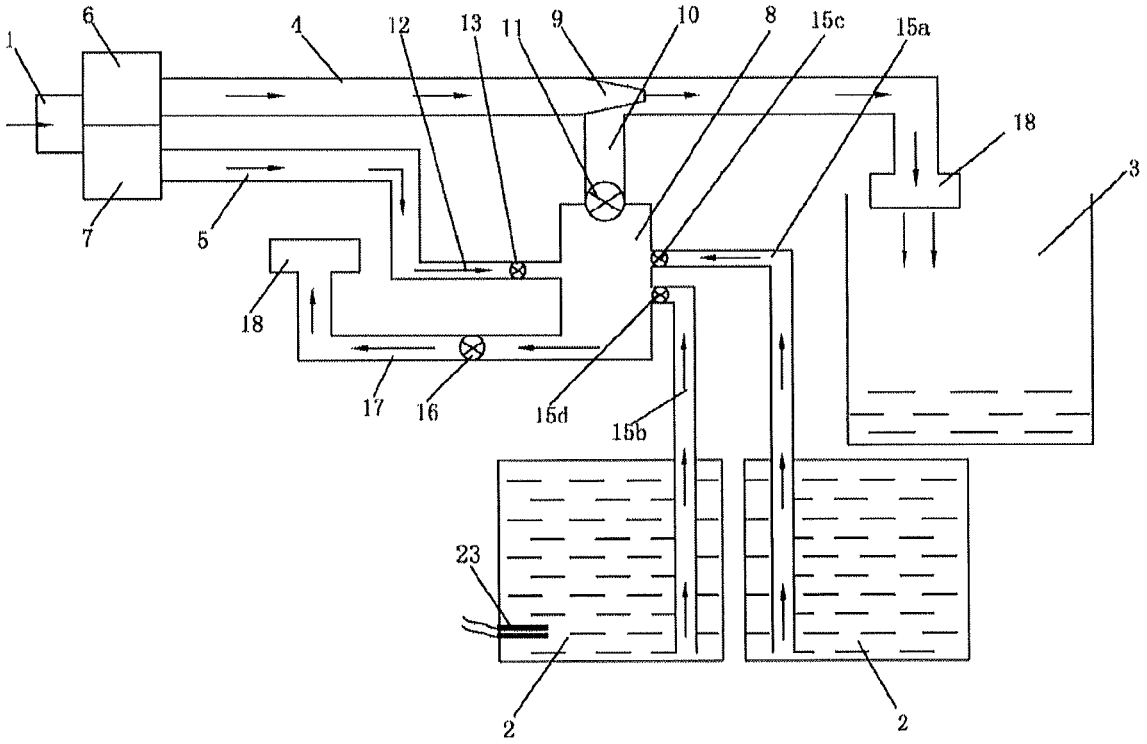
FIG. 2 is another schematic of configuration of the washing machine for automatically adding detergent in the invention.

As shown in FIG. 1 and FIG. 2, the washing machine in the invention comprises the water inlet 1, the detergent container 2 and the tub 3. Two water inflowing water passages which are respectively a main inflow waterway 4 and a rinse waterway 5 are set between the water inlet 1 and the tub 3. The main inlet valve 6 is arranged between the main inflow waterway 4 and the water inlet 1. The rinse water valve 7 is arranged between the rinse waterway 5 and the water inlet 1. The dosing container 8 which communicates with the detergent container 2 is arranged between the rinse waterway 5 and the tub 3. The venturi tube 9 by which the negative pressure is generated during passing water stream is arranged in the main inflow waterway 4. A branch pipe 10 which communicates with the dosing container 8 is arranged at the rear side of the outlet of the venturi tube 9. When water from the main inflow waterway 4 passes the venturi tube 9, the water stream becomes narrower and the water inflow velocity is accelerated by utilizing venturi effect, so that a relative vacuum area which communicates with the dosing container 8 via the branch pipe 10 is formed at the rear side of the outlet of the venturi tube 9. Thus negative pressure is generated in the dosing container 8, and then the detergent in the detergent container 2 which communicates with the dosing container is pumped into the dosing container 8 and is diluted and rushed into the tub 3 through inflowing water from the rinse waterway 5 to the dosing container 8.

Wherein, the sealing control valve 11 for sealing the connection is arranged at a connection between the dosing container 8 and the branch pipe 10, and the sealing control valve is buoyancy ball valve or a solenoid valve. In case of buoyancy ball valve, the valve will plug the connection when the dosing container is fully filled with the detergent. The water intake control valve 16 is arranged between the dosing container 8 and the tub 3, and is solenoid valve or one-way control valve. In case of one-way control valve, the valve can be flushed open after water inflood from the rinse waterway, and the detergent is rushed into the tub. Inflowing water from the main inflow waterway 4 and rinse waterway 5 all flows into the tub 3 through the same water inlet box 18 which is a multi-layer detergent disperser box, and other pipes communicating with the disperser box can also be arranged on the water inlet.

The detergent container 2 which hermetically communicates with the dosing container 8 is a detergent box fixed on the washing machine or a detergent container set on the outside of the washing machine, The detergent container can be connected through thread or by other means to provide a convenience for refilling the detergent. Two probes 23 for detecting whether there is the detergent are arranged in the detergent container 2, wherein, one probe is located at the side of the lower portion of the detergent container and inward inserted from the side. The other probe is located at the side of the lower portion of the container and inward inserted from the side (see FIG. 2), just as the first probe, or located at the upper side of the upper portion of the container and inserted from the upper to the lower (see FIG. 1). The two probes do not touch each other at their upper or lower portions. When the liquid in the detergent container is reduced to a level between the two probes, "off" status will be detected by the washing machine, and the users will be alerted to add the detergent and disinfectant; the dosing container 8 can communicate either to only one detergent container 2 or to multiple containers 2 containing different types of liquid for washing such as detergent, softener, and disinfectant, etc., and as shown in FIG. 1 and FIG. 2, the dosing container 8 only communicates with two types of detergent containers containing detergent and softener respectively.

Embodiment 1

As shown in FIG. 1, the wash control valve comprises electromagnets for generating drive source and magnetic ball valves encapsulated with rubber. Passage 12*a* and passage 12*b* corresponding to the two detergent containers are arranged between the rinse water valve 7 and the dosing container 8, and electromagnet 13*a* and electromagnet 13*b* are respectively arranged on passage 12*a* and passage 12*b*. Magnetic ball valves 14*a* and 14*b* are absorbed to close passage 12*a* and passage 12*b* and open passage 15*a* and passage 15*b* between the dosing container 8 and the detergent container 2 after electromagnet 13*a* and electromagnet 13*b* are powered on. Or the inflow water impacts magnetic ball valves 14*a* and 14*b* so that passage 12*a* and passage 12*b* between the rinse water valve 7 and the dosing container 8 are opened and passage 15*a* and passage 15*b* between the dosing container 8 and the detergent container 2 are closed.

Embodiment 2

As shown in FIG. 2, the wash control valve and detergent control valve are both solenoid valves, and the dosing container 8 communicates with the detergent containers 2 filled with detergent and softener respectively. Solenoid valves 15*e* and 15*d* are respectively set at the connections between the dosing container 8 and passage 15*a* and passage 15*b*, and there is only one passage 12 between the rinse water valve 7 and the dosing container 8. Solenoid valve 13 is also arranged at the connection between passage 12 and the dosing container 8.

Embodiment 3

Figure 3:
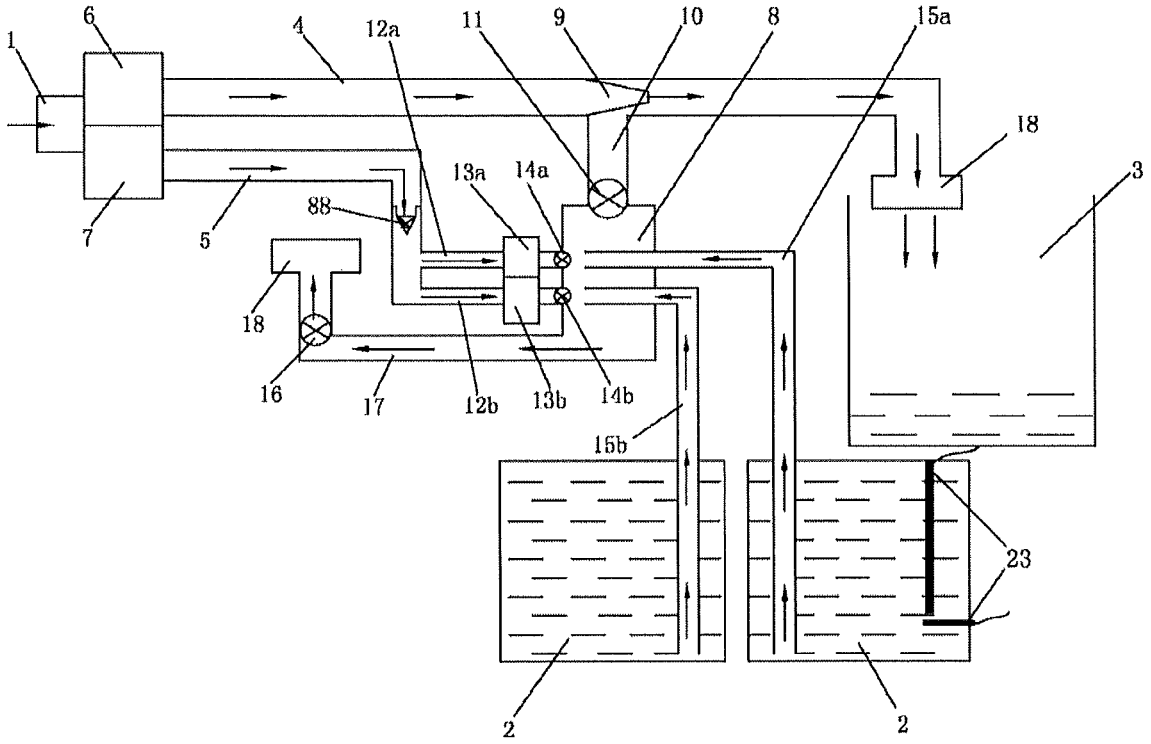
FIG. 3 is a further schematic of configuration of the washing machine for automatically adding detergent in the invention.

As shown in FIG. 3, the difference from embodiment 1 and embodiment 2 lies in that a one-way valve configuration 88 is arranged between the rinse water valve 7 and the wash control valve, thus avoids that the detergent reversely flows into water sources through the rinse water valve to pollute water when negative pressure is generated at one end of the rinse water valve.

The control method of the washing machine for auto-adding the detergent in the invention comprises: the amount of added detergent being automatically calculated by the washing machine according to quantity of clothes in the tub, texture, dirtiness, inflow water temperature, and/or water quality, as well as the selected wash procedures and the types of the detergents after the washing machine is powered on, and then the times of extraction of the detergent are derived according to the volume of the dosing container 8, and the detergent is automatically pumped into the dosing container 8 by the negative pressure generated by the inflow water during supplying water in the main inflow waterway 4, and is diluted and rushed into the tub 3 by the inflow water from the rinse waterway 5 into the dosing container 8.

The wash procedures adding the detergent comprise the wash process, pre-wash immersion and post-wash rinse, and the auto-added detergents at least comprise liquid detergent for removing dirt and softener for increasing softness of the clothes, and comprise the general type and the concentrated type. For general type detergent, multiple times of addition are generally required, and for concentrated type, one time of addition is sufficient.

Time for taking to fully fill the dosing container 8 with the detergent is mainly determined by the flow of the inflow water in the main inflow waterway 4 and the volume of the dosing container 8. Time for the inflow water reaching the pre-set water level is calculated according to flow of the inflow water in the main inflow waterway 4, and the maximum times of automatic adding the detergent are derived for each course of water inflow. If the time for water inflow in the main inflow waterway cannot meet the time for adding the required detergent, the user is alerted to manually add detergent, or select common or concentrated detergent according to types of the detergent, or select repeated wash.

When the detergent is required to be added each time, water is at first supplied from the main inflow waterway 4, and the dosing container 8 is automatically separated from the main inflow waterway 4 after the detergent is pumped into and fully fills the dosing container 8 by negative pressure; after the dosing container 8 is fully filled, the main inflow waterway 4 is closed, and inflow water from the rinse waterway 5 begins, the passages between the dosing container 8 and the rinse waterway 5 and the tub 3 are opened, and at the same time, the passage between the dosing container 8 and the detergent container 2 is closed, so that the detergent is diluted and rushed into the tub 3. In order to ensure that the step of adding the detergent does not affect amount of the detergent to be added for the next time, namely the dosing container 8 is required to be empty before adding detergent for the next time, it requires to close the main inflow waterway 4 and the rinse waterway 5 and empty the dosing container 8 after the detergent in the dosing container 8 is diluted and rushed into the tub 3 each time. Time for emptying is determined by the volume of the dosing container. Water is supplied by both the main inflow waterway 4 and the rinse waterway 5, when water inflow on the condition of without the detergent addition or after the detergent has already been completed.

Embodiment 4

As shown in FIG. 1, the sealing control valve 11, which is buoyancy ball valve, is arranged at the connection between the dosing container 8 and the branch pipe 10, and the water intake control valve 16 which is one-way control valve is arranged between the dosing container 8 and the tub 3. Passage s 12*a* and 12*b* corresponding to the two detergent containers are arranged between the rinse water valve 7 and the dosing container 8, and electromagnets 13*a* and 13*b* and magnetic ball valves 14*a* and 14*b* are respectively set on passages 12*a* and 12*b*, and passages 15*a* and 15*b* are arranged between the dosing container 8 and the detergent container 2 respectively.

Before starting water inflow in the main inflow waterway 4, the dosing container 8 is separated from the rinse waterway 5 and the tub 3, and the dosing container 8 communicates with the main inflow waterway 4 and the detergent container 2, i.e. the electromagnets 13*a* and 13*b* seal passages 12*a* and 12*b* between the rinse waterway 5 and the dosing container 8 and open passages 15*a* and 15*b* between the dosing container 8 and the detergent container 2 respectively in manner of attraction. The sealing control valve 11 is buoyancy ball valve. The dosing container 8 communicates with the branch pipe 10 since the buoyancy ball valve drops on condition of the absence of buoyancy. The water intake control valve 16 is one-way control valve, which seals passage 17 between the dosing container 8 and the tub 3.

Figure 4:
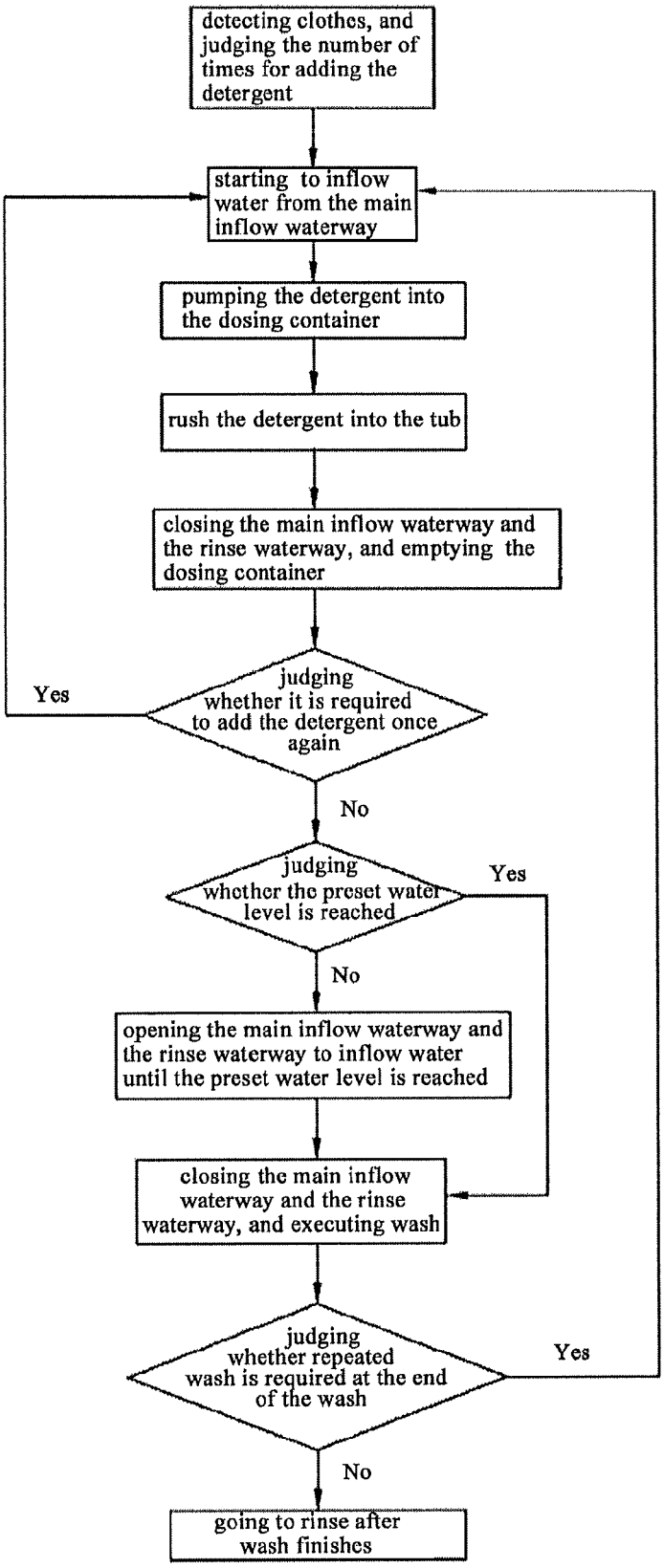
FIG. 4 is a flow diagram of washing of the washing machine in the invention.

As shown in FIG. 4, during washing, the amount of the detergent to be added is automatically calculated by the washing machine according to quantity of clothes in the tub, texture, dirtiness, inflow water temperature, and/or water quality, as well as the selected wash procedures and the types of the detergent, and then the times of extraction of the detergent are derived according to the volume of the dosing container 8. According to actual testing, if the volume of the dosing container 8 is 15 ml, then for most brands of detergents, the dosing container is fully filled within 2 min generally, the wash water varies between 20 and 40 L, and 1-2 time(s) of adding can be given for each course of wash at the ambient temperature of 20° C. when flow in the inlet valve is controlled at 7 L/min, thus, time when the main inlet valve 6 is open is 2 min and that when the rinse water valve 7 is open is 30 s. For general type detergent, one course of wash is executed, during which 2 times of detergent addition are required, with volume of about 30 ml; for concentrated type detergent, one course of wash is executed, during which 1 time of detergent addition is required, with volume of about 15 ml.

When starting to inflood water, the rinse water valve 7 is closed, the magnetic ball valve 14*b* closes passage 15*b* to prevent the softener from being drawn in, and the main inlet valve 6 is opened, the magnetic ball valve 14*a* opens passage 15*a*, the branch pipe 10 communicates with the dosing container 8 since the one-way sealing control valve 11 is without buoyancy, and water from the main inflow waterway 4 is rushed into the tub 3 through the water inlet box 18. A relative vacuum area is formed at the rear side of the outlet of the venturi tube 9, negative pressure is generated in the dosing container 8 through the branch pipe 10, and the water intake control valve 16 is closed and ensures impermeability of the dosing container 8, so that the detergent in the detergent container 2 enters into the dosing container 8 by utilizing the differential pressure between the external atmospheric pressure and the pressure in the dosing container 8, and fully fills the dosing container 8 for 2 min. Meanwhile, the main inlet valve 6 is closed, and the rinse water valve 7 is opened, the inflow water causes magnetic ball valves 14*a* and 14*b* to close passages 15*a* and 15*b* respectively, the sealing control valve 11 is closed, the water intake control valve 16 is opened by the inflow water in positive direction, and the detergent in the dosing container 8 is rushed into the tub 3 by the inflow water through the water inlet box 18. The rinse water valve 7 is closed and the dosing container 8 is emptied after flushing is completed, so that one time of addition is completed. In this case, it is detected whether the preset water level is reached. if another addition is not required. If the preset water level is not reached, the main inlet valve 6 and the rinse water valve 7 are opened to cause the water level in the tub to reach the preset level. If another addition is required, the above adding process is repeated, and then washing starts.

It is determined whether repeated wash is to be required according to the dirtiness of the wash water detected by the dirtiness sensor before the washing is completed, thus, the original wash process is divided into several stages to improve washing efficiency.

Figure 5:
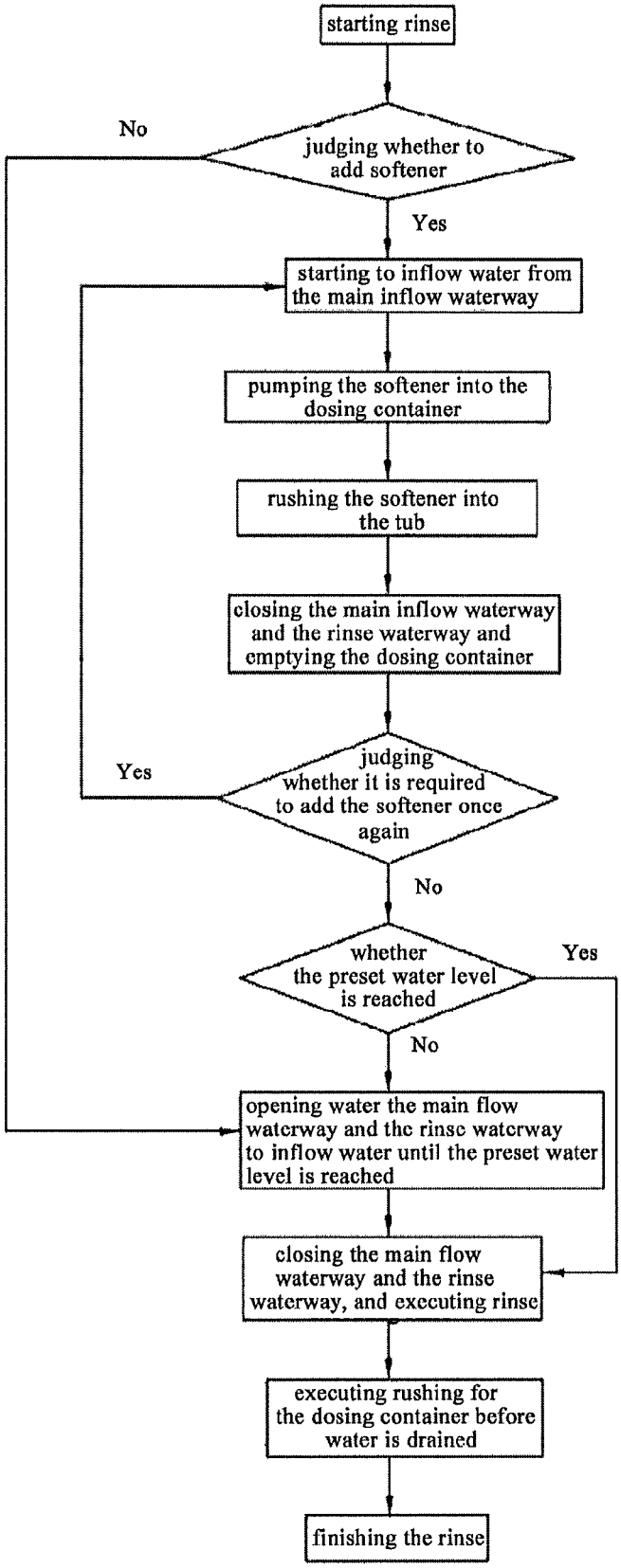
FIG. 5 is a flow diagram of rinse of the washing machine in the invention.

As shown in FIG. 5, when rinse is carried on after the washing is completed, it is realized that the softener being added into the detergent container 2 is via the opening/closing of the magnetic ball valve 14*b* during inflooding water, and magnetic ball valve 14*a* is controlled to close passage 15*a* to prevent the detergent from being drawn in. Other steps are the same as those of the detergent addition process in wash. Since the viscosity of the softener is generally lower, it is ensured that the dosing container 8 is normally fully filled within 30 s according to actual test, therefore, the main inlet valve 6 and the rinse water valve 7 are both opened for 30 s to complete extraction and flushing of the softener.

After the last rinse is completed, the rinse water valve 7 is opened for 30 s to flush the dosing container 8 again before drainage is carried on, thus residue of the detergent and softener is minimized as possible. Self-cleaning is completed, and it is avoided to come forth blockage of the valve port due to their solidification.

Embodiment 5

As shown in FIG. 2, the sealing control valve 11, which is a solenoid valve, is arranged at the connection between the dosing container 8 and the branch pipe 10, and the water intake control valve 16 arranged between the dosing container 8 and the tub 3 can be either a buoyancy ball valve or a solenoid valve. The dosing container 8 respectively communicates with the detergent containers 2 containing the detergent and softener, Solenoid valves 15*c* and 15*d* are respectively arranged at the connections between the dosing container 8 and passage 15*a* and passage 15*b*. There is only one passage, i.e. passage 12 between the rinse water valve 7 and the dosing container 8, and solenoid valve 13 is also set at the connection between passage 12 and the dosing container 8. Passage 15*a* communicates to the detergent container 2 containing the detergent, while passage 15*b* communicates to the detergent container 2 containing the softener.

As shown in FIG. 4, in the process of washing, water is supplied from the main inflow waterway 4, the sealing control valve 11 and the solenoid valve 15*c* are opened, and the solenoid valves 13 and 15*d* as well as the water intake control valve 16 are closed. Water is supplied from the main inflow waterway 4, and the inflow water passes the venturi tube 9. Due to venture effect, a relative vacuum area is formed at the rear side of the outlet of the venturi tube 9, and negative pressure is generated in the dosing container 8 through the branch pipe 10. The main inlet valve 6 is closed, the rinse water valve 7, solenoid valve 13 and water intake control valve 16 are opened, and the sealing control valve 11 and the solenoid valves 15*c* and 15*d* are closed, after the detergent is pumped into and fully fills the dosing container 8 by the negative pressure. The inflow water from the rinse waterway 5 comes into the dosing container 8 and dilutes the detergent, and then the diluted detergent is rushed into the tub 3 through the water inlet box 18. After flushing is completed, the rinse water valve 7 is closed and the dosing container 8 is emptied, so that one time of addition is completed. At the moment, if another time of adding is not required, it is detected whether the preset water level is reached. If the preset water level is not reached, the main inlet valve 6 and the rinse water valve 7 are opened to cause the water level in the tub to reach the preset level. If another time of adding is required, the above adding process is repeated, and then wash starts.

As shown in FIG. 5, when rinse is carried on after washing is completed. It is realized to add softener in the detergent container 2 by opening the solenoid valve 15*d* during inflowing water, and the solenoid valve 15*c* is closed to prevent the detergent from being drawn in. Other steps are the same as those of addition the detergent in washing process. As viscosity of softener is generally lower, it is ensured that the dosing container 8 is normally fully filled within 30 s according to actual test, therefore, the main inlet valve 6 and the rinse water valve 7 are both opened for 30 s to complete extraction and flushing of the softener.

After the last rinse is completed, the rinse water valve 7 is opened for 30 s to flush the dosing container 8 again before water drainage, thus minimizes residue of the detergent and softener, completes self-cleaning and prevents valve port from blockage due to their solidification.

The invention provides a washing machine for automatically adding the detergent at the most reasonable amount by the negative pressure generated from the water stream under the premise of no impact on washing effects. The washing machine is simple configuration, and manual addition of detergent which may result in shortage or excess of detergent is avoided; at the same time, costs arising in other configurations for automatically adding detergent are saved. And it is relieved that the detergent drainage in the washing method for automatically adding the detergent pollutes on the circumstance, the full automation of washing course is realized, and the washing efficiency is improved.

The said embodiments are only descriptions of the preferred embodiments of the invention, and do not limit the concepts and scope of the invention. Changes and modifications made by the person skilled in the art on the technical solutions of the invention, do not deviate from the design spirit of the invention, belong to the scope of protection in the invention.

The invention claimed is:

1. A washing machine comprising:

a water inlet, a detergent container and a tub, wherein, two water inflowing water passages which are respectively a main inflow waterway and a rinse waterway are set between the water inlet and the tub, a dosing container which communicates with the detergent container is arranged between the rinse waterway and the tub, a venturi tube by which a negative pressure is generated during passage of a water stream is arranged in the main inflow waterway, a branch pipe which communicates with the dosing container is arranged at the rear side of the outlet of the venturi tube, and the detergent in the detergent container is pumped into the dosing container by the negative pressure generated during feeding water from the main inflow waterway into the tub, and then is diluted and supplied into the tub by the inflowing water from the rinse waterway to the dosing container, wherein, a main inlet valve is arranged between the main inflow waterway and the water inlet, a rinse water valve is arranged between the rinse waterway and the water inlet, a wash control valve is set between the rinse water valve and the dosing container, a sealing control valve for sealing a connection is arranged at the connection between the dosing container and the branch pipe, and a water intake control valve is arranged between the dosing container and the tub.

2. The washing machine according to claim 1, wherein, a one-way valve configuration is set between the rinse water valve, and the wash control valve.

3. The washing machine according to claim 1, wherein, the detergent container is at least one in quantity, and each detergent container is filled with liquid detergent, liquid softener, liquid disinfectant, or other liquid for washing, passages with the same quantity as that of the detergent container are arranged between the rinse water valve and the dosing container, and between the detergent container and the dosing container, the wash control valve is set on each passage, and the wash control valve simultaneously controls a communication among the passages and a seal between the corresponding dosing container and the detergent container, and simultaneously controls a closure of the passages and a communication between the corresponding dosing container and the detergent container.

4. The washing machine according to claim 3, wherein, the wash control valve comprises an electromagnet generating drive and magnetic ball valves encapsulated with rubber, after the electromagnet is electrified, the magnetic ball valves are absorbed to close the passage between the rinse water valve and the dosing container and open the passage between the dosing container and the detergent container, or after the electromagnet is powered off, the inflow water from the rinse waterway impacts the magnetic ball valves, so that the passage between the rinse water valve and the dosing container is opened and the passage between the dosing container and the detergent container is closed, and the sealing control valve and the water intake control valve are a buoyancy ball valve or a solenoid valve.

5. The washing machine according to claim 1, wherein, the dosing container communicates with the detergent containers containing different types of detergents respectively, a detergent control valve is set at a connection between the detergent container and the dosing container, and the wash control valve between the rinse water valve and the dosing container is set at the connection of the dosing container.

6. The washing machine according to claim 5, wherein, the wash control valve and the detergent control valve are both solenoid valves, the sealing control valve and the water intake control valve are buoyancy ball valves or solenoid valves.

7. The washing machine according to claim 1, wherein, the detergent container is a detergent box fixed on the washing machine or a detergent container set on the outside of the washing machine, and the detergent container hermetically communicates with the dosing container.

8. The washing machine according to claim 1, wherein, inflow water from the main inflow waterway and the rinse waterway flows into the tub via the same water inlet box.

9. The washing machine according to claim 1, wherein, two probes for detecting whether there is detergent are arranged in the detergent container, among which, one is located at a side of a lower portion of the detergent container and inward inserted from the side, the other is located at a side of a lower portion of the container and inserted inward from the side, or located at an upper side of an upper portion of the container and inserted from the upper to the lower, and the two probes do not touch each other at their upper or lower portions.

10. A method for automatically adding a detergent in the washing machine in claim 1 by negative pressure, in which water is supplied into the tub through the main inflow waterway and the detergent is supplied into the tub through the rinse waterway, wherein, the detergent in the detergent container is pumped into the dosing container by a negative pressure generated by the water stream of the main inflow waterway during the supply of water in the main inflow waterway, and then the detergent is diluted and supplied into the tub by inflow water from the rinse waterway into the dosing container, to automatically add the desired quantity of detergent by one or more times of repeated feeding.

11. The method for automatically adding the detergent by negative pressure according to claim 10, wherein, the amount of the detergent to be added is calculated according to a quantity of clothes in the tub, texture, dirtiness, inflow water temperature, and/or water quality, and the number of times of extraction of the detergent into the dosing container by the negative pressure of the water stream is calculated.

12. The method for automatically adding the detergent by negative pressure according to claim 10, wherein, the venturi tube is arranged in the main inflow waterway, the water stream becomes narrower and the inflow velocity is accelerated by utilizing the venturi effect, so that a relative vacuum area which communicates with the dosing container is formed at the rear side of the outlet of the venturi tube, and the detergent in the detergent container which communicates with the dosing container is pumped into the dosing container by a negative pressure generated in the dosing container.

13. The method for automatically adding the detergent by negative pressure according to claim 10, wherein, before water is supplied from the main inflow waterway, the dosing container is separated from the rinse waterway and the tub, and the dosing container communicates with the main inflow waterway and the detergent container, after the detergent is pumped into the dosing container at a set rate by the negative pressure during water supply in the main inflow waterway, the dosing container is separated from the main inflow waterway, and water begins to be supplied from the rinse waterway, a passage between the dosing container and the rinse waterway and the tub is opened, and a passage between the dosing container and the detergent container is closed, so that the detergent is diluted and rushed into the tub.

14. The method for automatically adding the detergent by negative pressure according to claim 13, wherein, a common control valve is commonly used for controlling between the dosing container and the rinse waterway, between the dosing container and the detergent container, the dosing container communicates with the detergent container when the dosing container is separated from the rinse waterway, and otherwise, the dosing container is separated from the detergent container when the dosing container communicates with the rinse waterway.

15. The method for automatically adding the detergent by negative pressure according to claim 14, wherein, after the total amount of the detergent meets the pre-set volume for washing by repeatedly pumping the detergent into the dosing container by the negative pressure, as well as by diluting and rushing the detergent into the tub through the rinse waterway, water from the rinse waterway and the main inflow waterway is simultaneously supplied until the washing water in the tub reaches a pre-set water level, and inflowing water is then stopped.

16. A control method for the washing machine in claim 1, wherein, the amount of the detergent to be added is automatically calculated by the washing machine according to a quantity of clothes in the tub, texture, dirtiness, inflow water temperature, and/or water quality, as well as the selected wash procedures and the types of the detergent, after the washing machine is powered on, the times of extraction of the detergent are derived according to the volume of the dosing container, the detergent is automatically pumped into the dosing container by the negative pressure generated by the inflow water flowing in the venturi tube during the supply of water from the main inflow waterway, the detergent is diluted and supplied into the tub by inflow water from the rinse waterway to the dosing container, and the action for automatically adding the detergent on a quantitative basis is realized by one or more repeated dosings.

17. The control method according to claim 16, wherein, time to fully fill the dosing container with the detergent is mainly determined by the flow of the inflow water in the main inflow waterway and the volume of the dosing container, time for an inflow water reaching the set water level is calculated according to the flow of the inflow water in the main inflow waterway, the maximum times of automatically adding the detergent are derived for each course of water inflow, and if the time for inflow water in the main inflow waterway cannot meet the time for adding the required detergent, the user is reminded to manually add detergent, select common or concentrated detergent according to types of the detergent, or select repeated wash.

18. The control method according to claim 16, wherein, when the detergent is required to be added each time, water is at first supplied from the main inflow waterway, the dosing container is automatically separated from the main inflow waterway after the detergent is pumped into and fully fills the dosing container by negative pressure; and after the dosing container is fully filled, the main inflow waterway is closed, and water inflow from the rinse waterway takes place, the passage between the dosing container and the rinse waterway and the tub is opened, at the same time, the passage between the dosing container and the detergent container is closed, so that the detergent is diluted and supplied into the tub.

19. The control method according to claim 18, wherein, the main inflow waterway and the rinse waterway are closed, and the dosing container is emptied, after the detergent in the dosing container is diluted and supplied into the tub each time, and time for emptying is determined according to the volume of the dosing container.

20. The control method according to claim 19, wherein, water is supplied by both the main inflow waterway and the rinse waterway, when water inflow on the condition of without the detergent addition or after the detergent has already been completed.

21. The control method according to claim 20, wherein, the specific steps for automatically adding the detergent in the wash course are the following:

First step, detecting clothes, and judging the number of times for adding the detergent;

Second step, starting to inflood water from the main inflow waterway;

Third step, pumping the detergent into the dosing container;

Fourth step, closing the main inflow waterway and opening the rinse waterway, diluting and rushing the detergent into the tub;

Fifth step, closing the rinse waterway, and emptying the dosing container;

Sixth step, judging whether it is required to add the detergent once again, if yes, turning to the second step, or otherwise, going to the next step;

Seventh step, judging whether the preset water level is reached, if yes, going to the ninth step, or otherwise, going to the next step;

Eighth step, inflooding water from both the main inflow waterway and the rinse waterway until the preset water level is reached;

Ninth step, closing the main inflow waterway and the rinse waterway, and executing wash; and Tenth step, judging whether repeated wash is required at the end of the wash, if yes, turning to the second step, or otherwise, going to rinse after wash finishes.

22. The control method according to claim 20, wherein, the specific steps for automatically adding softener in the rinse course are the following:

First step, starting rinse;

Second step, judging whether to add softener, if yes, going to the next step, or otherwise, going to the eighth step;

Third step, starting to inflood water from the main inflow waterway, and pumping the softener into the dosing container;

Fourth step, closing the main inflow waterway and opening the rinse waterway, diluting and rushing the softener into the tub;

Fifth step, closing the rinse waterway and emptying the dosing container;

Sixth step, judging whether it is required to add the softener once again, if yes, turning to the third step, or otherwise, going to the next step;

Seventh step, judging whether the preset water level is reached, if yes, turning to the ninth step, or otherwise, going to the next step;

Eighth step, inflooding water from both the main flow waterway and the rinse waterway until the preset water level is reached;

Ninth step, closing the main flow waterway and the rinse waterway, and executing rinse; and Tenth step, finishing the rinse, and executing rushing for the dosing container before water is drained.

* * * * *